US011426045B2

(12) United States Patent
Pougher et al.

(10) Patent No.: US 11,426,045 B2
(45) Date of Patent: Aug. 30, 2022

(54) SURFACE CLEANING APPARATUS

(71) Applicant: TTI (MACAO COMMERCIAL OFFSHORE) LIMITED, Macau (CN)

(72) Inventors: Simon Matthew Pougher, Chester (GB); Darren Holmes, Birmingham (GB); Richard Waters, Birmingham (GB); Anna Jaanus, Birmingham (GB); Jose Casella, Birmingham (GB)

( * ) Notice: Subject to any disclaimer, the term of this patent is extended or adjusted under 35 U.S.C. 154(b) by 349 days.

(21) Appl. No.: 16/624,679

(22) PCT Filed: Jun. 15, 2018

(86) PCT No.: PCT/GB2018/051654

§ 371 (c)(1),
(2) Date: Dec. 19, 2019

(87) PCT Pub. No.: WO2018/234756

PCT Pub. Date: Dec. 27, 2018

(65) Prior Publication Data

US 2020/0113398 A1 Apr. 16, 2020

(30) Foreign Application Priority Data

Jun. 19, 2017 (WO) ..... PCT/GB2017/051786
Jun. 19, 2017 (WO) ..... PCT/GB2017/051788
(Continued)

(51) Int. Cl.
*A47L 9/16* (2006.01)
*A47L 5/24* (2006.01)
(Continued)

(52) U.S. Cl.
CPC ..... *A47L 9/1616* (2013.01); *A47L 5/24* (2013.01); *A47L 5/28* (2013.01); *A47L 5/36* (2013.01);
(Continued)

(58) Field of Classification Search
CPC ..... A47L 5/12; A47L 5/24; A47L 5/28; A47L 5/36; A47L 9/102; A47L 9/1409;
(Continued)

(56) References Cited

U.S. PATENT DOCUMENTS 4,426,211 A * 1/1984 Ataka ..... A47L 9/1409 15/327.7
6,536,072 B2 3/2003 Thur et al.
(Continued)

FOREIGN PATENT DOCUMENTS

CN 1313046 C 5/2007
CN 101822508 9/2010
(Continued)

OTHER PUBLICATIONS

International Search Report and Written Opinion for Application No. PCT/GB2018/051654 dated Sep. 28, 2018 (16 pages).
(Continued)

*Primary Examiner* — Marc Carlson
(74) *Attorney, Agent, or Firm* — Michael Best & Friedrich LLP

(57) ABSTRACT

A surface cleaning apparatus includes a housing having an elongate axis (H) and supports a suction source, and a dirt separation device having an elongate axis (A). The dirt separation device includes a separator for separating dirt from dirt-laden air, and a dirt collection chamber for receiving separated dirt. The dirt separation device or a part of the dirt separation device is releasably connected to the housing. A passage member that transports dirt-laden air to the dirt separation device has an elongate axis (B). The dirt separation device is pivotally moveable relative to the housing to effect release of the dirt separation device.

25 Claims, 13 Drawing Sheets

(30) Foreign Application Priority Data

Dec. 5, 2017 (GB) ..... 1720282
Dec. 5, 2017 (GB) ..... 1720294

(51) Int. Cl.

| | |
|---|---|
| ***A47L 5/28*** | (2006.01) |
| ***A47L 5/36*** | (2006.01) |
| ***A47L 9/10*** | (2006.01) |
| ***A47L 9/14*** | (2006.01) |
| ***A47L 9/32*** | (2006.01) |
| ***A47L 9/24*** | (2006.01) |
| ***B04C 5/187*** | (2006.01) |
| ***B04C 5/26*** | (2006.01) |

(52) U.S. Cl.
CPC ..... *A47L 9/102* (2013.01); *A47L 9/1409* (2013.01); *A47L 9/1481* (2013.01); *A47L 9/165* (2013.01); *A47L 9/1608* (2013.01); *A47L 9/1633* (2013.01); *A47L 9/1658* (2013.01); *A47L 9/1683* (2013.01); *A47L 9/1691* (2013.01); *A47L 9/242* (2013.01); *A47L 9/322* (2013.01); *A47L 9/327* (2013.01); *B04C 5/187* (2013.01); *B04C 5/26* (2013.01)

(58) Field of Classification Search
CPC .... A47L 9/1481; A47L 9/1608; A47L 9/1616; A47L 9/1633; A47L 9/165; A47L 9/1658; A47L 9/1683; A47L 9/1691; A47L 9/242; A47L 9/248; A47L 9/322; A47L 9/327; B04C 5/187; B04C 5/26
See application file for complete search history.

(56) References Cited

U.S. PATENT DOCUMENTS

| | | | | |
|---|---|---|---|---|
| 7,014,675 | B2 | 3/2006 | Nakai et al. | |
| 7,175,682 | B2 | 2/2007 | Nakai et al. | |
| 7,325,274 | B2 | 2/2008 | Jeong | |
| 7,380,308 | B2 | 6/2008 | Oh et al. | |
| 7,462,210 | B2 | 12/2008 | Lee | |
| 7,555,808 | B2 | 7/2009 | Oh et al. | |
| 7,655,060 | B2 | 2/2010 | Nakai et al. | |
| 7,810,210 | B2 | 10/2010 | Yoo et al. | |
| 7,950,104 | B2 | 5/2011 | Yoo | |
| 7,979,953 | B2 | 7/2011 | Yoo | |
| 7,981,181 | B2 * | 7/2011 | Yoo | A47L 9/122 55/459.1 |
| 8,191,203 | B2 | 6/2012 | Yoo | |
| 8,505,160 | B2 | 8/2013 | Yoo | |
| 8,661,610 | B2 | 3/2014 | Liu et al. | |
| 8,728,186 | B2 | 5/2014 | Kim et al. | |
| 8,925,145 | B2 | 1/2015 | Wilson | |
| 9,009,914 | B2 | 4/2015 | Tran | |
| 9,314,139 | B2 | 4/2016 | Conrad et al. | |
| 9,320,397 | B2 | 4/2016 | Gotschall et al. | |
| 9,451,853 | B2 | 9/2016 | Conrad et al. | |
| 9,451,858 | B2 | 9/2016 | Stickney et al. | |
| 9,565,981 | B2 | 2/2017 | Conrad et al. | |
| 2004/0154126 | A1 * | 8/2004 | Hansen | A47L 9/1683 15/353 |
| 2004/0237248 | A1 * | 12/2004 | Oh | A47L 9/248 15/353 |
| 2006/0225243 | A1 | 10/2006 | Kim | |
| 2007/0094837 | A1 | 5/2007 | Jeon et al. | |
| 2009/0019663 | A1 * | 1/2009 | Rowntree | A47L 5/26 15/347 |
| 2010/0088841 | A1 * | 4/2010 | Holm | A47L 5/24 15/344 |
| 2011/0056045 | A1 | 3/2011 | Sepke et al. | |
| 2012/0111367 | A1 * | 5/2012 | Liu | A47L 9/2857 134/18 |
| 2012/0222251 | A1 * | 9/2012 | Conrad | A47L 9/12 15/347 |
| 2012/0272472 | A1 * | 11/2012 | Conrad | A47L 5/225 15/323 |
| 2013/0091655 | A1 * | 4/2013 | Smith | A47L 9/28 15/344 |
| 2013/0091813 | A1 * | 4/2013 | Smith | A47L 9/325 55/342.2 |
| 2014/0137362 | A1 | 5/2014 | Smith | |
| 2014/0137363 | A1 * | 5/2014 | Wilson | A47L 9/1683 15/347 |
| 2015/0182085 | A1 | 7/2015 | Tran et al. | |
| 2015/0289736 | A1 * | 10/2015 | Rowntree | A47L 9/1691 15/347 |
| 2015/0289738 | A1 | 10/2015 | Tran | |
| 2016/0015228 | A1 * | 1/2016 | Conrad | A47L 5/225 15/344 |
| 2016/0066757 | A1 * | 3/2016 | Conrad | A47L 9/1683 15/344 |
| 2016/0215516 | A1 * | 7/2016 | Hayes | B04C 9/00 |
| 2016/0242610 | A1 | 9/2016 | Smith et al. | |
| 2017/0079491 | A1 * | 3/2017 | Dimbylow | A47L 9/1616 |
| 2017/0112341 | A1 * | 4/2017 | Han | A47L 7/02 |
| 2018/0213985 | A1 * | 8/2018 | Song | A47L 9/1683 |
| 2019/0008348 | A1 * | 1/2019 | Conrad | A47L 9/1666 |
| 2019/0313870 | A1 * | 10/2019 | Ward | A47L 5/30 |
| 2020/0315412 | A1 * | 10/2020 | Ward | A47L 9/322 |

FOREIGN PATENT DOCUMENTS

| | | | | |
|---|---|---|---|---|
| CN | 201870568 | U | 6/2011 | |
| CN | 102217910 | A | 10/2011 | |
| CN | 102342795 | A | 2/2012 | |
| CN | 102475523 | | 5/2012 | |
| CN | 202776160 | U | 3/2013 | |
| CN | 203122295 | U | 8/2013 | |
| CN | 103417161 | | 12/2013 | |
| CN | 203354473 | U | 12/2013 | |
| CN | 203539239 | U | 4/2014 | |
| CN | 103932638 | A | 7/2014 | |
| CN | 203802395 | U | 9/2014 | |
| CN | 104083125 | A | 10/2014 | |
| CN | 203852304 | U | 10/2014 | |
| CN | 203987858 | U | 12/2014 | |
| CN | 204336819 | U | 5/2015 | |
| CN | 105534410 | A | 5/2016 | |
| CN | 205286243 | U | 6/2016 | |
| CN | 205286245 | U | 6/2016 | |
| CN | 105852737 | A | 8/2016 | |
| CN | 205667533 | U | 11/2016 | |
| CN | 205849382 | U | 1/2017 | |
| CN | 106361223 | A | 2/2017 | |
| CN | 106388705 | A | 2/2017 | |
| CN | 106510549 | A | 3/2017 | |
| CN | 206183153 | U * | 5/2017 | |
| DE | 102015106645 | A1 | 11/2016 | |
| EP | 1438918 | A1 | 7/2004 | |
| EP | 1457150 | A2 | 9/2004 | |
| EP | 1955631 | A1 | 8/2008 | |
| EP | 2581012 | A1 | 4/2013 | |
| EP | 2792287 | A2 | 10/2014 | |
| EP | 2826410 | A1 | 1/2015 | |
| GB | 2508035 | A | 5/2014 | |
| GB | 2542387 | A | 3/2017 | |
| WO | 2006021489 | A1 | 3/2006 | |
| WO | 2010026237 | A1 | 3/2010 | |
| WO | 2014141780 | A1 | 9/2014 | |
| WO | WO-2014141780 | A1 * | 9/2014 | A47L 5/24 |
| WO | WO-2016008049 | A1 * | 1/2016 | A47L 9/246 |

OTHER PUBLICATIONS

Hoover, "Assembly, Use and Maintenance," Quick Start Manual for Zen Canister, © 2012 (2 pages).

* cited by examiner

SURFACE CLEANING APPARATUS

CROSS-REFERENCE TO RELATED APPLICATIONS

The present application is a U.S. National Phase application of PCT/GB2018/051654 filed Jun. 15, 2018, which claims priority to PCT/GB2017/051786 filed Jun. 19, 2017, PCT/GB2017/051788 filed Jun. 19, 2017, Application No. GB 1720282.1 filed Dec. 5, 2017 and Application No. GB 1720294.6, filed Dec. 5, 2017, the entire contents of all of which are herein incorporated by reference.

DESCRIPTION OF INVENTION

This invention relates to a surface cleaning apparatus.

Different kinds of surface cleaning apparatus are known. Upright cleaners are known which have an upright part pivotally connected to a floor head and a user grasps a handle of the upright part to move the floor head back and forth over a floor surface to be cleaned. Cylinder cleaners are known for which the main operative components, i.e. suction source, dirt collection chamber, are supported by a housing having wheels. A rigid elongate member fluidly connects the operative components in the housing to a floor head and the user grasps a handle of the elongate member to move the floor head along the floor surface to be cleaned whilst the housing is moved by pulling the elongate member in the desired direction. Handheld cleaners are known which have a housing supporting the operative components of the cleaner and for which the housing can be easily carried by the user during cleaning; such cleaners may or may not include a battery. Stick-vac or pole-vac cleaners are known which are formed by fluidly connecting a housing of a handheld unit to a floor head via a relatively rigid elongate member. For such cleaners, the user can steer the floor head by moving the handheld unit in the desired direction.

Surface cleaning apparatus have a dirt separation device for separating dirt from dirt-laden air which includes the dirt lifted from the surface being cleaned through the floor head. The dirt separation device may have a separator such as a bag for separating the dirt and a dirt collection chamber in which the bag is supported as part of a so-called "bagged cleaner" for which dirt is retained in the bag as dirt-laden air is passed through the bag. The dirt separation device may have a separator in the form of a cyclonic separator which causes dirt-laden air to flow in a swirling motion around the body of the separator to cause the dirt to separate from the dirt-laden air. In such cleaners, a dirt collection chamber receives the separated dirt. The dirt collection chamber may be a part of the same body. For the surface cleaning apparatus described, it is necessary to empty the dirt collection chamber after use. The user may take the surface apparatus to a waste collection container and open a cover of the dirt collection chamber to tip the dirt therein into the waste collection chamber. For other surface cleaning apparatus a user may detach the body from the cleaner and take the body to a waste collection chamber for emptying thereof into the waste collection chamber.

Surface cleaning apparatus having a compact configuration and/or ergonomic design are desirable. It is also desirable for a user to be able to detach the body including the dirt collection chamber to obtain access thereto in a comfortable and convenient manner.

According to an aspect of the present invention we provide a surface cleaning apparatus for cleaning a surface including:

a housing supporting:
- a suction source;
- a dirt separation device having an elongate axis (A) including:
  - a separator for separating dirt from dirt-laden air; and
  - a dirt collection chamber for receiving separated dirt;
- a passage member for transporting dirt-laden air to the dirt separation device, the passage member having an elongate axis (B);

a user graspable handle having an elongate axis (C);

a coupling device moveable between a first position in which the coupling device inhibits release of the dirt separation device from the housing and a second position in which the coupling device permits release of the dirt separation device from the housing; and an actuator member for effecting movement of the coupling device between its first and second positions, wherein the elongate axis (B) of the passage member and the elongate axis (C) of the user graspable handle lie in a plane (P1), and the elongate axis (A) of the dirt separation device intersects the plane (P1).

Optionally the actuator member is positioned generally centrally on the dirt separation device with respect to an elongate axis of the dirt separation device.

Optionally the actuator member is positioned forwardly of the user graspable handle.

Optionally, in plan view, the actuator member, user graspable handle and the passage member lie on a common axis.

Optionally the actuator member is positioned closer to the passage member than the actuator is positioned relative to the user graspable handle.

Optionally the coupling device, in its first position, couples the passage member to the dirt separation device to inhibit relative movement therebetween.

Optionally the dirt separation device includes an inlet passage member for fluid communication with the passage member, and wherein the coupling device couples the inlet passage member to the passage member.

Optionally the coupling device is connected to the inlet passage member of the dirt separation device.

Optionally the actuator includes a user graspable portion.

Optionally the user graspable portion is positioned on the dirt separation device.

Optionally the apparatus includes a user graspable member positioned on the dirt separation device, and wherein the user graspable member and user graspable portion of the actuator member are positioned to permit a user to handle the dirt separation device by grasping both the user graspable member and the actuator member with one hand.

Optionally in plan view, the user graspable member and the user graspable portion of the actuator member are spaced apart along a line which lies in plane (P1).

Optionally the dirt separation device includes first and second ends connected by a wall and a portion of the wall is accessible to a user when the dirt separation device is supported by the housing.

Optionally the actuator is provided on the portion of the wall which is accessible to a user.

Optionally a filter for filtering relatively clean air outputted from the dirt collection chamber is supported in the dirt separation device.

Optionally the coupling device is in an extended condition when the coupling device is in its first position and the coupling device is in a retracted condition when the coupling device is in its second position.

Optionally the actuator includes a cam member and the coupling member includes a cam follower surface for engaging with the cam member when the actuator is operated such that movement of the actuator member effects movement of the coupling member.

Optionally the cam member and cam follower surface co-operate so as to translate a rotational movement of the cam member into a linear movement of the coupling device.

Optionally the dirt separation device is pivotally moveable relative to the housing.

Optionally the dirt separation device is pivotally connected to a portion of the user graspable handle.

According to an aspect of the present invention we provide a surface cleaning apparatus including:

a housing having an elongate axis (A), the housing supporting:
- a suction source;
- a dirt separation device having an elongate axis (A) including:
  - a separator for separating dirt from dirt-laden air; and
  - a dirt collection chamber for receiving separated dirt,
- wherein the dirt separation device or a part of the dirt separation device is releasably connected to the housing;

a passage member for transporting dirt-laden air to the dirt separation device, the passage member having an elongate axis (B), wherein the dirt separation device is pivotally moveable relative to the housing to effect release of the dirt separation device.

According to an aspect of the present invention we provide a surface cleaning apparatus for cleaning a surface including:

a housing supporting:
- a suction source;
- a dirt separation device having an elongate axis (A) including:
  - a separator for separating dirt from dirt-laden air; and
  - a dirt collection chamber for receiving separated dirt;

wherein, in normal use, the housing is supported for movement along a floor surface and the elongate axis (A) of the dirt separation device is parallel with the floor surface; and a passage member for fluidly connecting an elongate member to which a tool is connectable to an inlet of the dirt separation device, the passage member having an elongate axis (B), wherein the dirt separation device is pivotally moveable relative to the housing to effect release of the dirt separation device.

The apparatus include a pivotal connection between the dirt separation device and the housing.

Optionally the pivotal connection is provided at a position of the dirt separation device generally central thereof with respect to an elongate axis (A) of the dirt separation device.

Optionally the pivotal connection includes a recess to permit the detachment of the dirt separation device therefrom.

The apparatus optionally include a coupling device moveable between a first position in which the coupling device inhibits release of the dirt separation device from the housing and a second position in which the coupling device permits release of the dirt separation device from the housing.

The apparatus optionally include an actuator member for effecting movement of the coupling device between its first and second positions.

Optionally the actuator member is positioned generally centrally on the dirt separation device with respect to an elongate axis (A) of the dirt separation device.

The apparatus optionally include a user graspable handle having an elongate axis (C).

Optionally the dirt separation device is positioned forwardly of the user graspable handle, and optionally or preferably forwardly of the source of suction.

Optionally the elongate axis (B) of the passage member and the elongate axis (C) of the user graspable handle lie in a plane (P1), and the elongate axis (A) of the dirt separation device intersects the plane (P1).

Optionally the passage member is provided by the housing or the passage member is provided by the dirt separation device.

According to an aspect of the present invention we provide a surface cleaning apparatus including:

a housing supporting:
- a suction source;
- a dirt separation device having an elongate axis (A) including:
  - a separator for separating dirt from dirt-laden air;
  - an inlet passage member for transporting dirt-laden air to the separator; and
  - a dirt collection chamber for receiving separated dirt;
- a passage member for transporting dirt-laden air to the dirt separation device, the passage member having an elongate axis (B);
- a coupling device operable between a first position in which the coupling device inhibits release of the dirt separation device from the housing and a second position in which the coupling device permits release of the dirt separation device from the housing;

wherein the coupling device, in its first position, couples the passage member to the inlet passage member to inhibit relative movement therebetween.

Optionally the coupling device is provided on the dirt separation device.

Optionally the coupling device is provided on the inlet passage member.

The apparatus optionally include an actuator member operable to move the coupling device between its first and second positions.

Optionally the actuator member is provided on the dirt separation device.

Optionally the separator is a cyclonic separator.

The apparatus optionally include a user graspable handle having an elongate axis (C).

Optionally the dirt separation device is positioned forwardly of the user graspable handle, and optionally or preferably forwardly of the source of suction.

Optionally the elongate axis (B) of the passage member and the elongate axis (C) of the user graspable handle lie in a plane (P1), and the elongate axis (A) of the dirt separation device intersects the plane (P1).

A surface cleaning apparatus according to any preceding aspect/optional aspect including:

a surface cleaning tool;

an elongate member having an elongate axis, said elongate member fluidly connecting the surface cleaning tool to the dirt separation device and including a passage for carrying dirt-laden air from the surface cleaning tool thereto.

Optionally the apparatus is a handheld cleaner.

Optionally the apparatus is a cylinder cleaner.

Embodiments of the invention will be set out below by way of example only with reference to the accompanying figures, of which:

Figure 1:
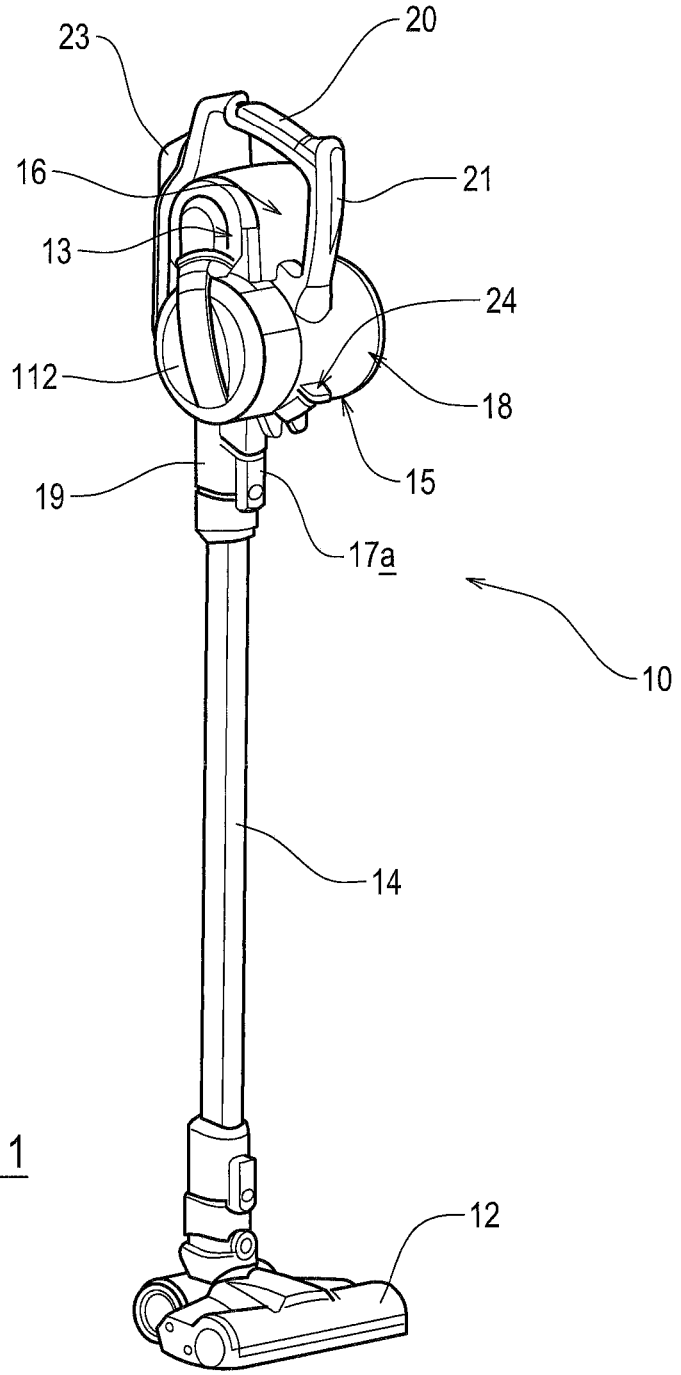
FIG. 1 is a perspective view of a surface cleaning apparatus.
Figure 4:
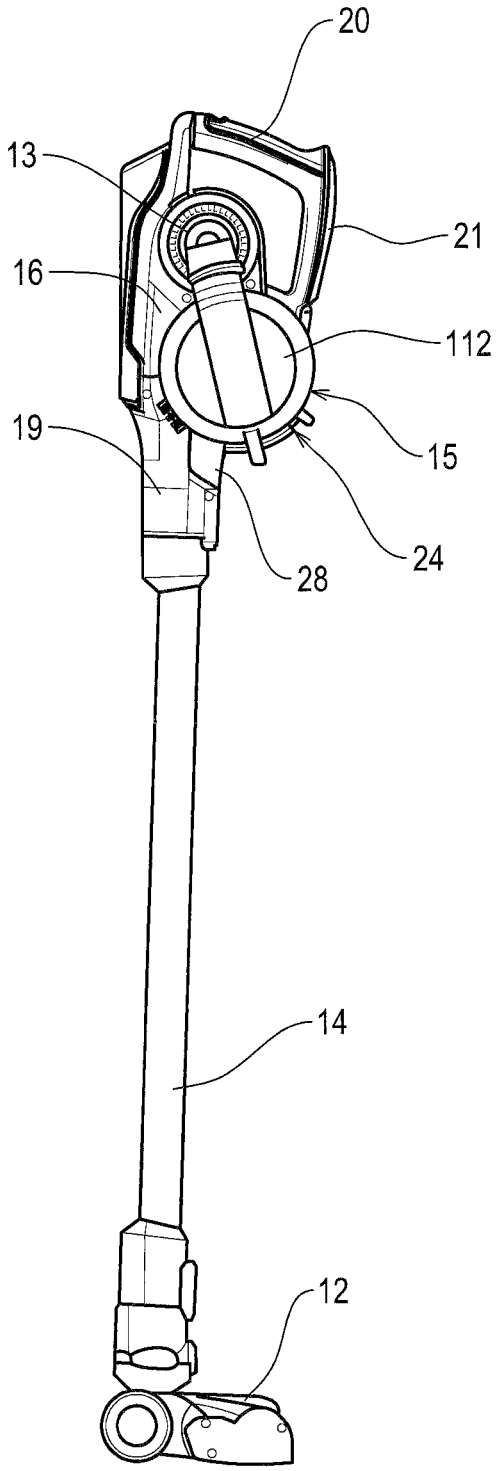
FIG. 4 is an opposite side view of the apparatus of FIG. 1.
Figure 5:
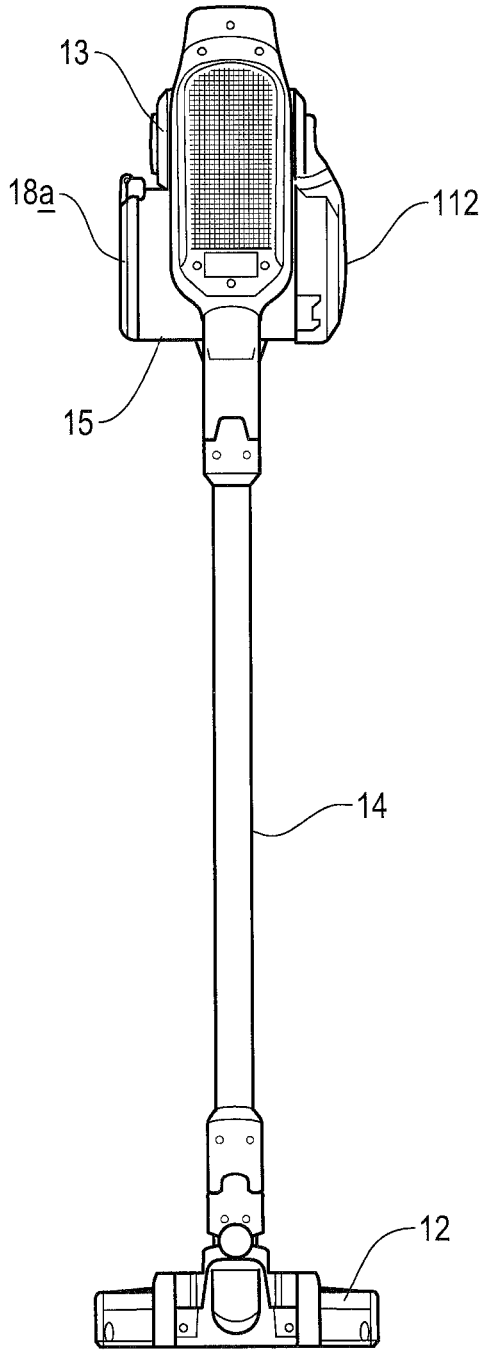
FIG. 5 is a rear view of the apparatus of FIG. 1.
Figure 6:
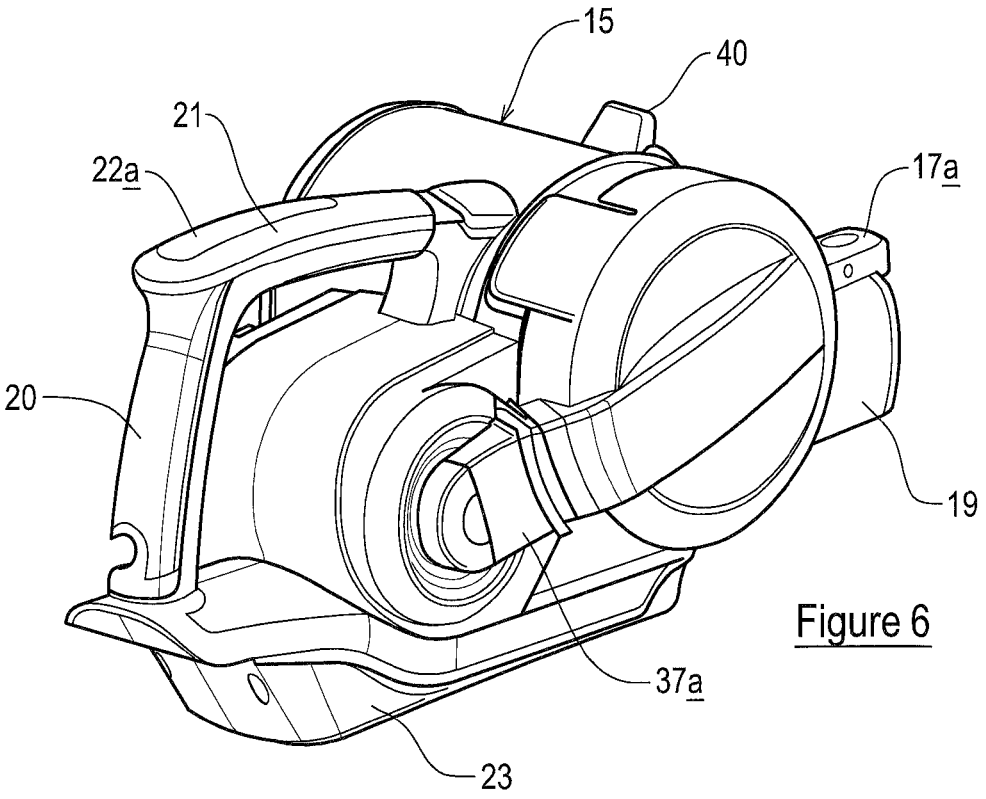
FIG. 6 is a perspective view of a housing of the apparatus of FIG. 1, which housing is operable as a handheld surface cleaning apparatus.
Figure 7:
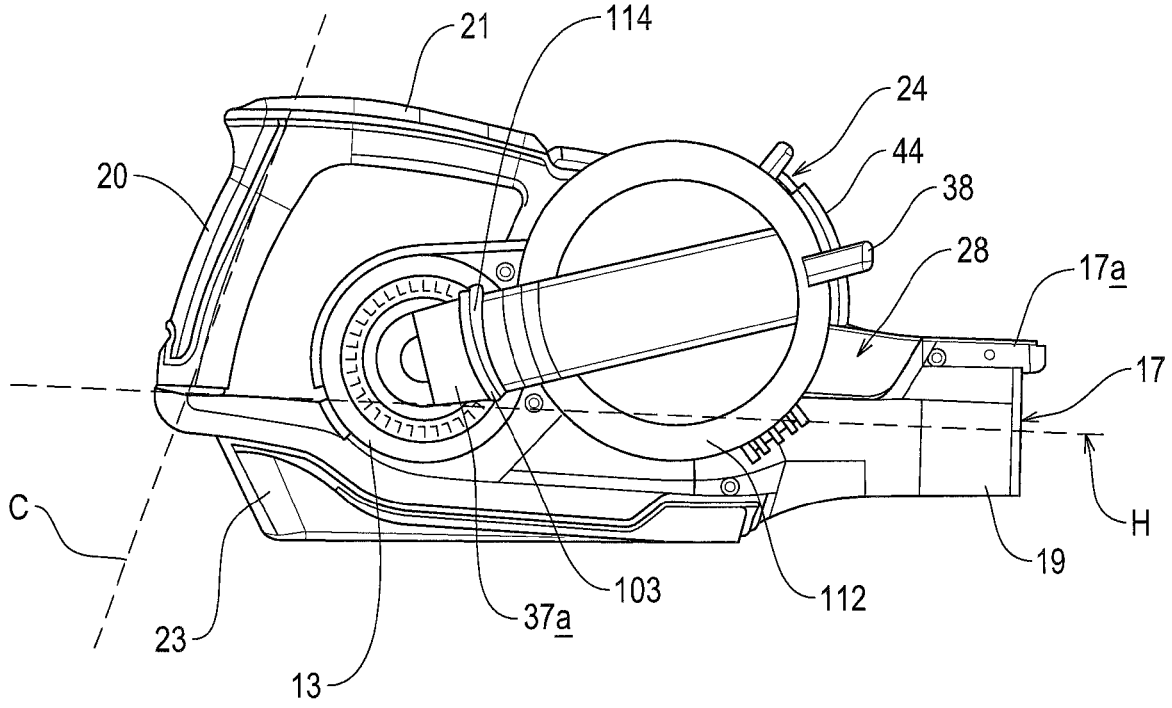
FIG. 7 is a side view of the housing of FIG. 6.
Figure 10A:
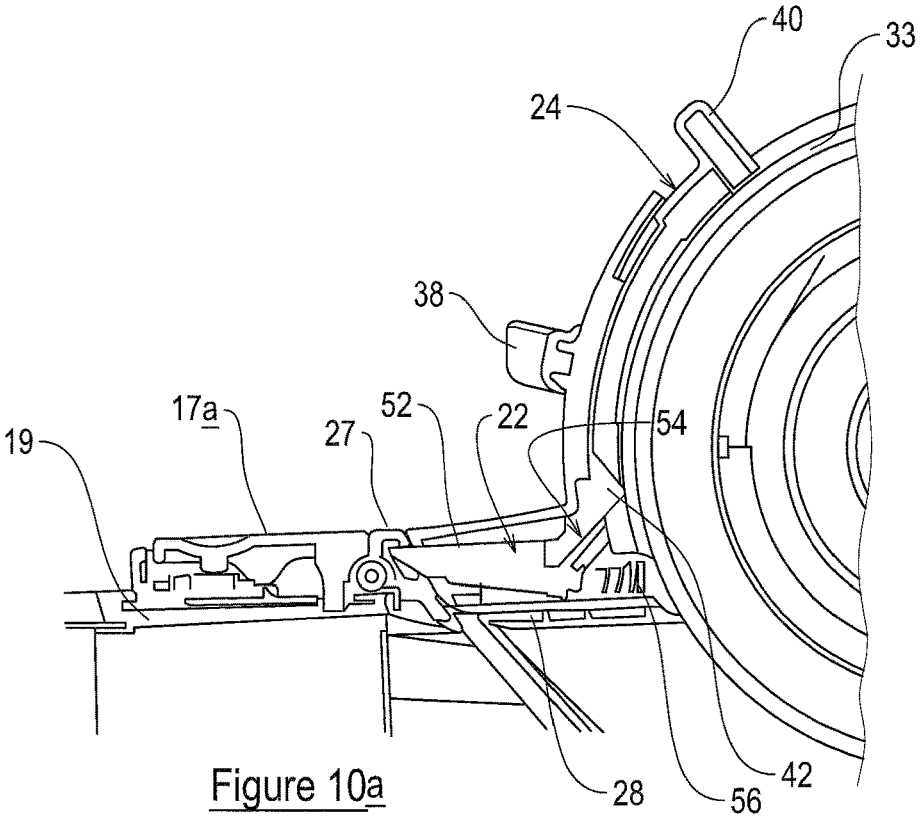
Figure 10B:
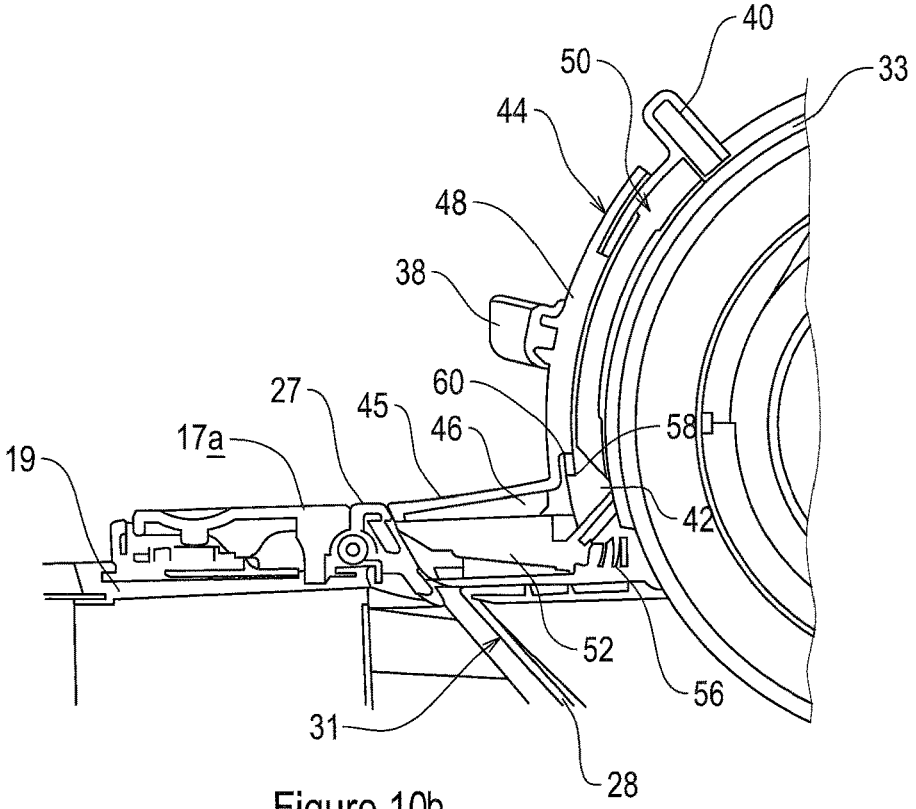
Figure 11:
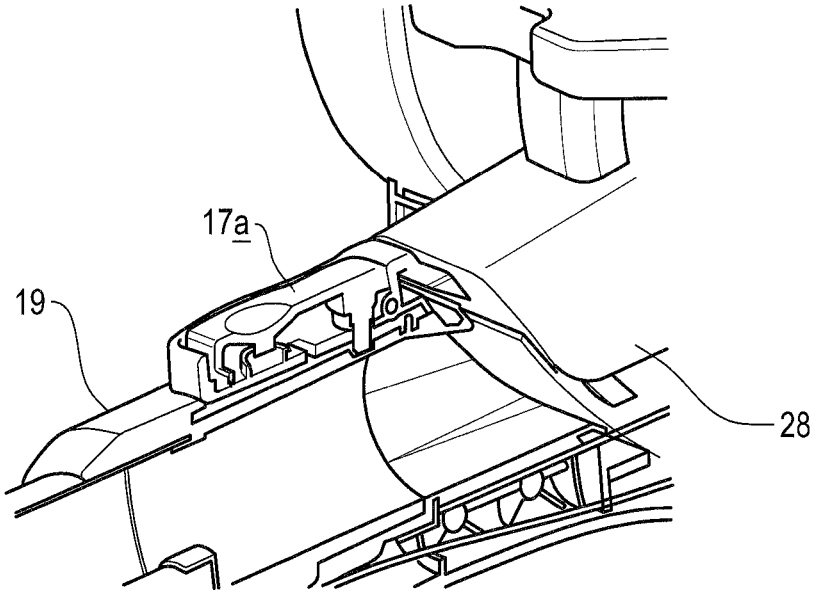
Figure 12:
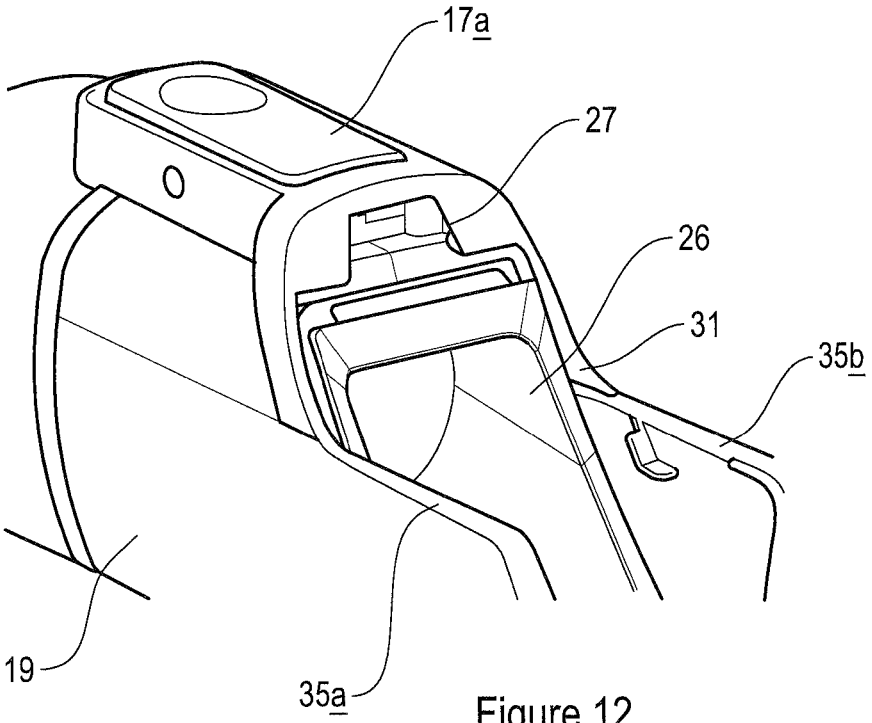
Figure 13:
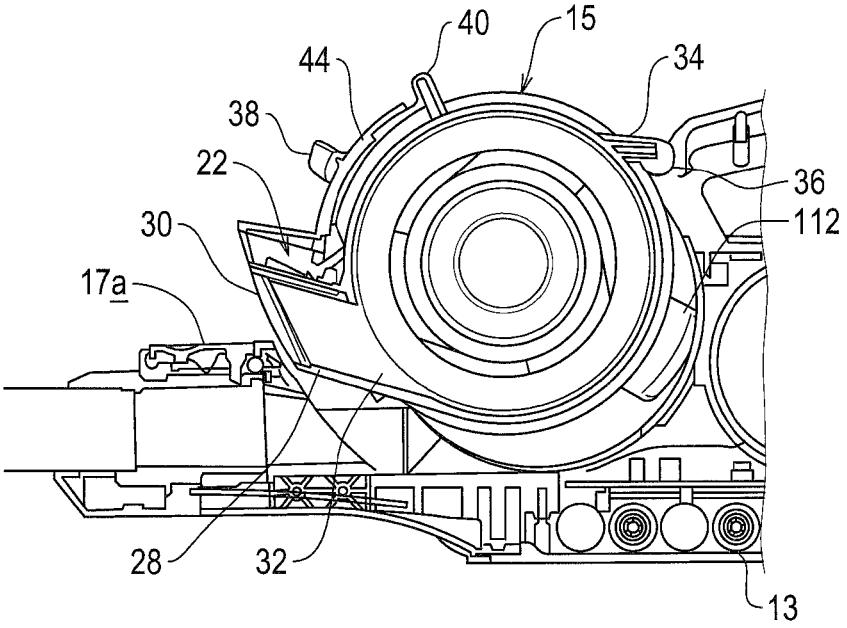
Figure 14:
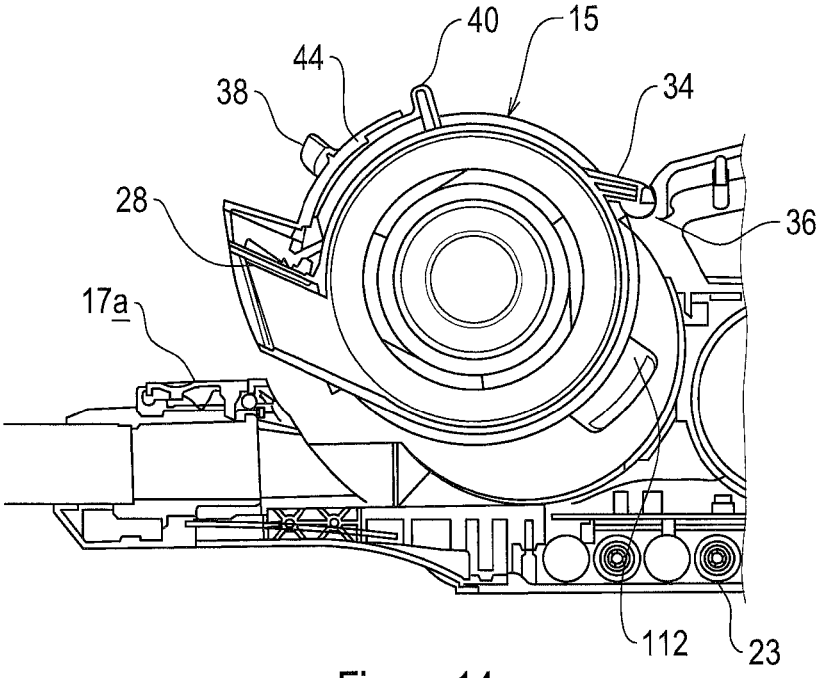
Figure 15:
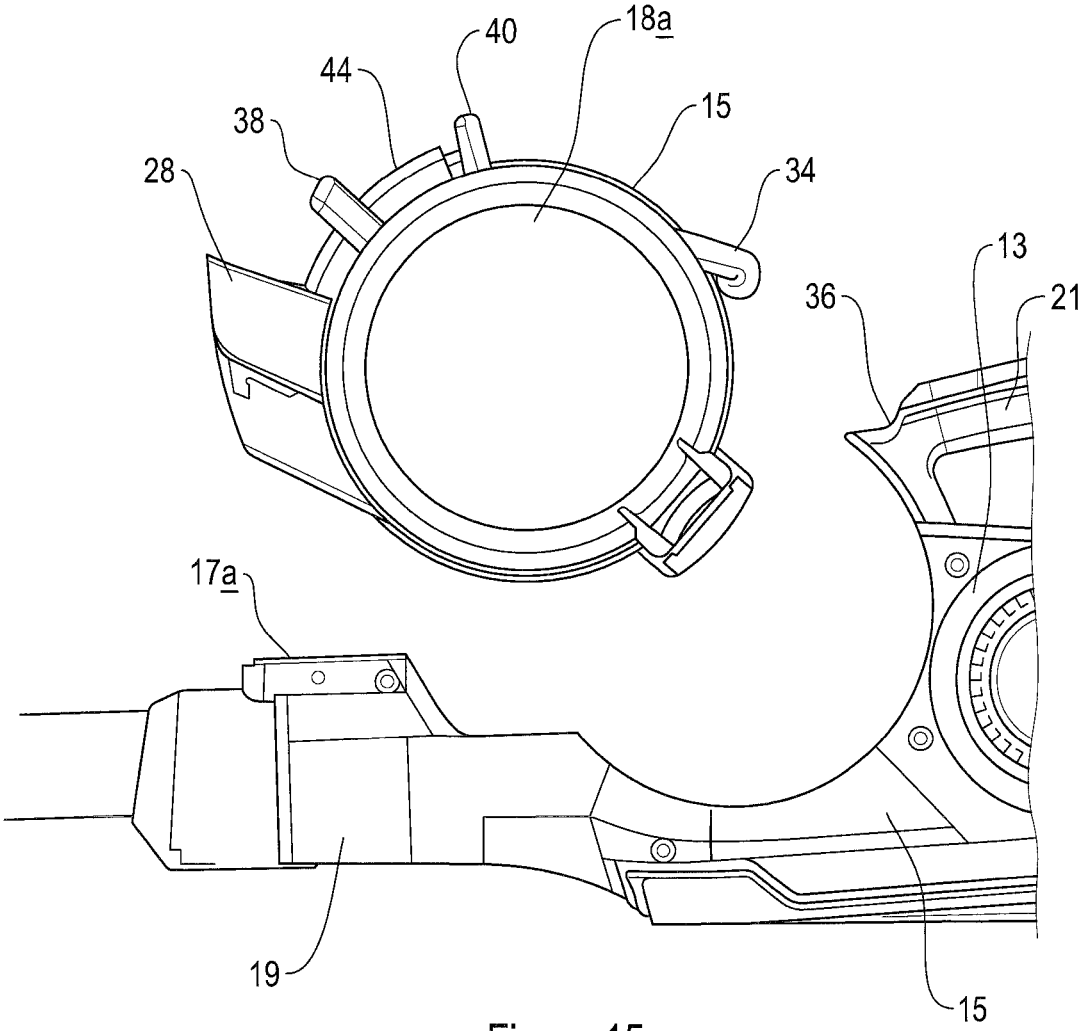
Figure 16:
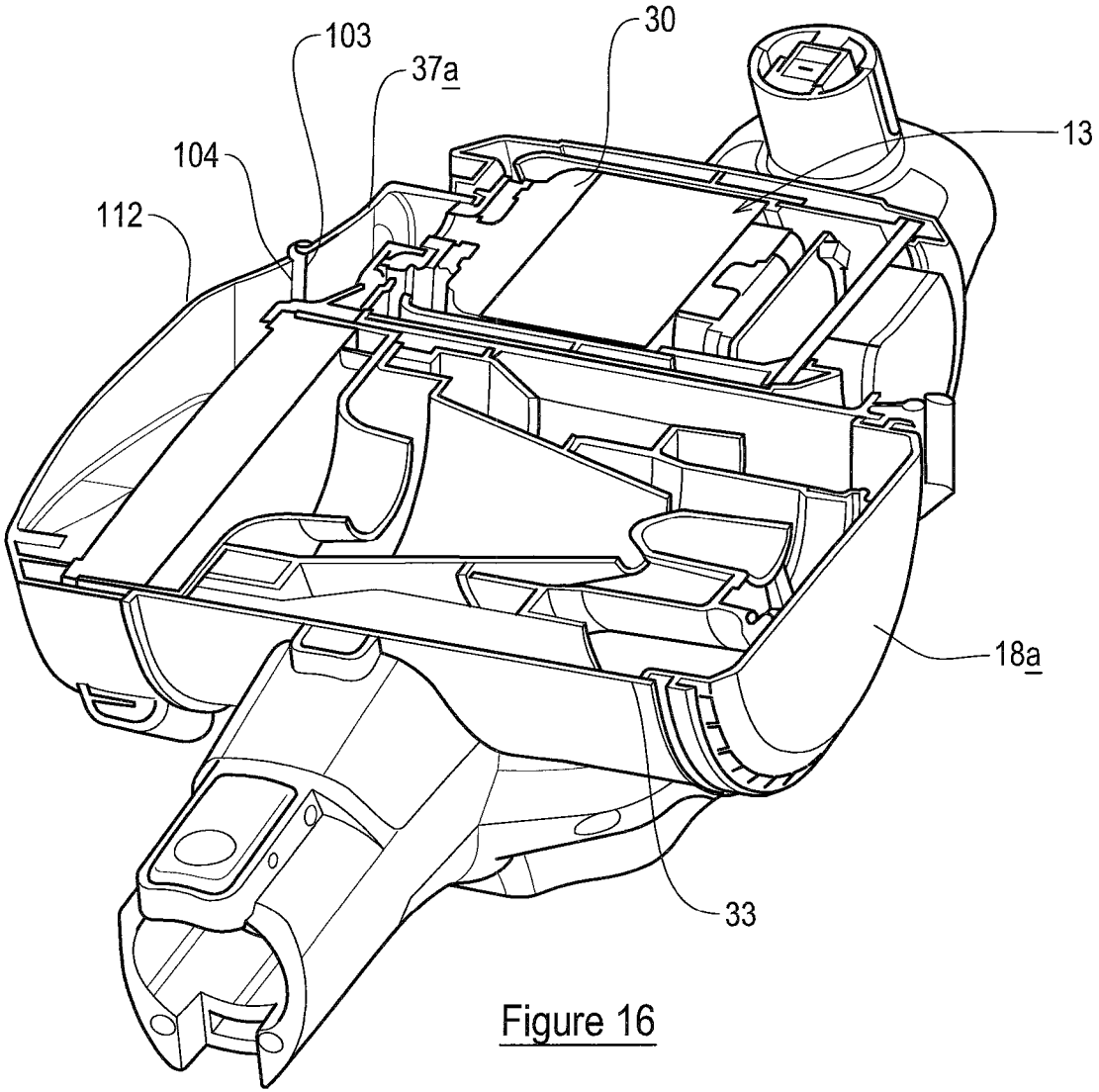

FIGS. 10*a* and 10*b* are partial cross-sectional views of the housing from the opposite side to that shown in FIG. 7 in first and second positions of operation respectively;

FIG. 11 is a partial cross-sectional view of the apparatus of FIG. 1;

FIG. 12 is a further partial cross-sectional view of the apparatus of FIG. 1;

FIGS. 13 and 14 are further partial cross-sectional views of the apparatus of FIG. 1 in respective stages of operation;

FIG. 15 is a partial side view of the apparatus of FIG. 1 in a further stage of operation; and FIG. 16 is a cross-sectional view of the housing of FIG. 4.

Referring to the figures, these show a surface cleaning apparatus 10 in accordance with the present invention. The apparatus 10 includes a surface cleaning tool 12 (a floor head in this example), a housing 16 having an elongate axis H and an elongate member 14, having an elongate axis E, connecting the surface cleaning tool 12 to the housing 16. The elongate member 14 is relatively rigid. The housing 16, in this example, is operable as a handheld surface cleaning apparatus, commonly known as a hand vac, when the elongate member 14 is not connected thereto, and in this state the housing 16 can be used with or without the surface cleaning tool 12 connected thereto. The housing 16 supports a suction source 13, a dirt separation device 15 including a dirt collection chamber 18 and a separator which, in this embodiment, is a cyclonic separator. The dirt separation device 15 is generally cylindrical. The dirt separation device 15 also includes a filter (not shown) for cleaning the relatively clean air emitted by the dirt separation device. The dirt separation device 15 has an elongate axis A. The suction source 13 and dirt separation device 15 are spaced apart along axis H of the housing 16. The dirt separation device 15 is positioned forwardly of the source of suction 13. In embodiments, the suction source 13 is an electric motor driving a rotatable fan, but any appropriate suction source may be used. All that is necessary is for the suction source to be able to draw air through the surface cleaning tool 12 and elongate member 14 towards the dirt collection chamber 18.

Figure 9:
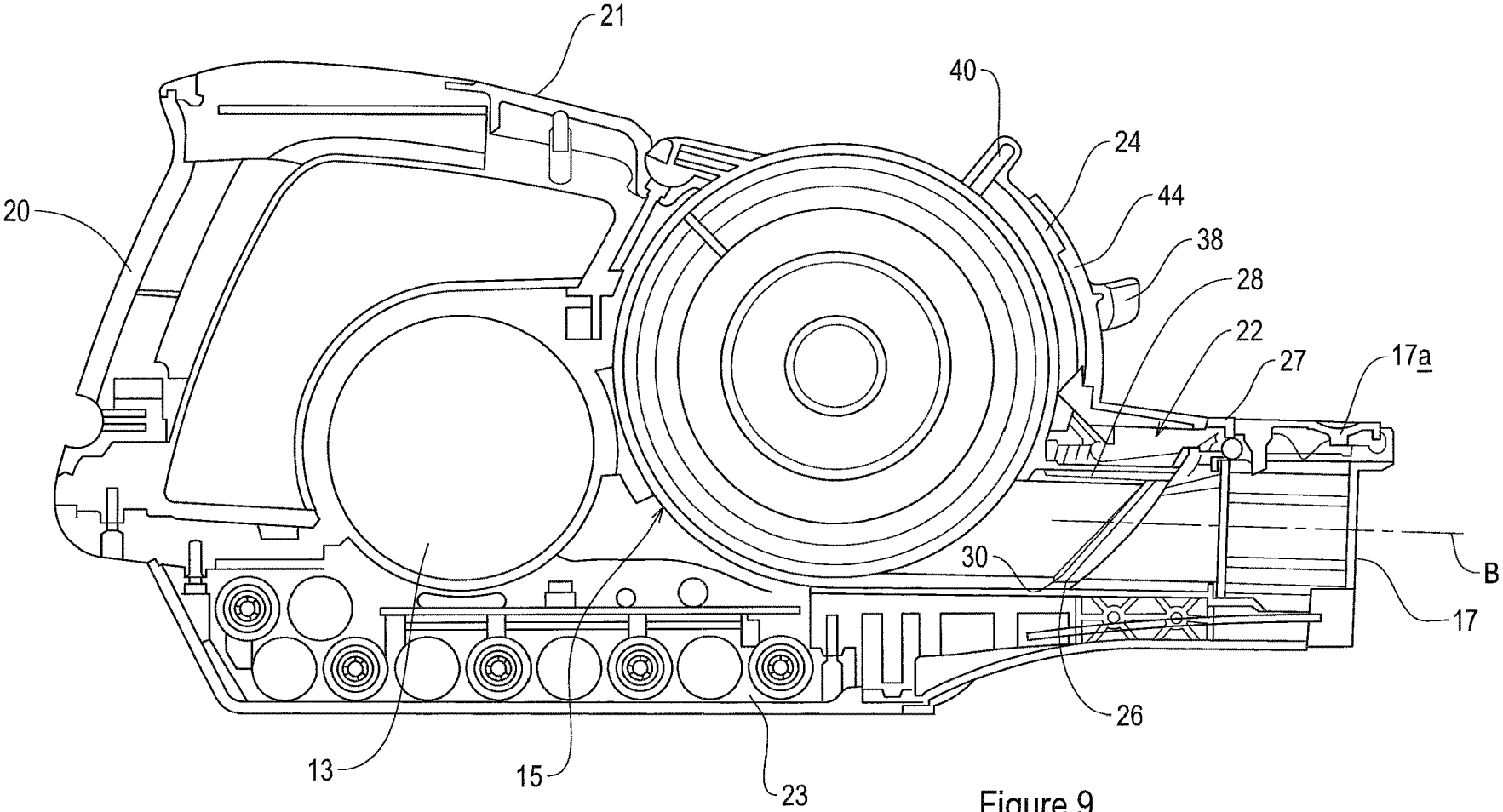
FIG. 9 is a cross-sectional view of the housing from the same side as shown in FIG. 7.

The dirt separation device 15 may be detached from the housing 16. The dirt separation device 15 is pivotally connected to the housing 16. With reference to FIG. 9, the surface cleaning apparatus 10 includes a coupling device 22 moveable between a first position in which the coupling device 22 inhibits release of the dirt separation device 15 from the housing 16 and a second position in which the coupling device 22 permits release of the dirt separation device 15 from the housing 16. The surface cleaning apparatus 10 includes an actuator member 24 for effecting movement of the coupling device 22 between its first and second positions.

In embodiments for which the dirt separation device 15 includes a cyclonic separator, the dirt separation device 15 may be removable from the housing 16 as a single unit containing the dirt collection chamber 18 and the cyclonic separator. In other embodiments for which the separator is a cyclonic separator, a portion of the cyclonic separator (e.g. a second stage separating chamber thereof) and/or the associated filter may stay in place on the housing 16 and the remainder of the dirt separation device 15 may be removable including the dirt collection chamber 18. In embodiments for which the separator is a bag, the bag may be removable with the dirt separation device as a single unit, or the bag may remain in place for other embodiments whilst the remainder of the dirt separation device is removable.

In embodiments, the housing 16 supports or contains a battery 23 to provide electrical power to the suction motor and other components of the apparatus 10. The battery 23 is of a generally elongate shape but may be of a different shape in other embodiments.

In embodiments, the housing 16 includes a passage member 19 in fluid communication with an inlet of the dirt separation device 15. The passage member 19 is generally elongate. The passage member 19 has an elongate axis B. A first end of the passage member 19 defines an inlet 17 for receiving dirt-laden air. The first end is connectable to the elongate member 14 or surface cleaning tool 12. A second end of the passage member 19 defines an outlet 26. When connected, axis B is parallel to the elongate axis E of the elongate member 14. In embodiments, axis B may be co-axial or offset from the elongate axis E.

In embodiments, the dirt separation device 15 includes an inlet passage member 28 for fluid communication with the passage member 19. The inlet passage member 28 is generally elongate. The inlet passage member 28 rests within a recessed channel defined by respective opposing side walls 35*a*, 35*b* of the housing 16. The inlet passage member 28 defines a passage between its inlet 30 and outlet 32 which fluidly connects the passage member 19 to the dirt separation device. Inlet 30 of the inlet passage member 28 connects to the outlet 26 of the passage member 19 and the outlet 32 of the inlet passage member 28 connects to an inlet of the dirt separation device. The inlet passage member 28 has an end face 31 which abuts an end face 29 of the passage member 19 when the dirt separation device 15 is supported on the housing 16.

The passage member 19 includes a formation 27 at the end of the passage member 19 which includes the outlet 26. The formation 27 is positioned above the outlet 26. The formation 27 defines a central opening for receiving a portion of the coupling device 22. In embodiments having a coupling device 22, the formation 27 may be configured or positioned differently. All that is required is that formation 27 permits the coupling device 22 to couple the dirt separation device 15 to the housing 16. As will be described, when the coupling device 22 is received in the formation 27, the coupling device couples the passage member 19 to the dirt separation device 15 to inhibit relative movement therebetween. For embodiments, the dirt separation device 15 cannot be pivoted relative to the housing 16 when the coupling device 22 is in its first position.

In embodiments, there may be no inlet passage member 28 and instead the passage member 19 is connected to the inlet of the dirt separation device directly. In other embodiments, the housing 16 has no passage member and the inlet passage member 28 is formed as part of the dirt separation device 15 and connects to a tool or elongate member directly. In such embodiments, the coupling device 22 may be provided elsewhere on the dirt separation device or housing and it may not couple the inlet passage member 28 to the housing 16.

Whilst in the present embodiment the dirt separation device 15 includes a separator in the form of a cyclonic separator, embodiments are envisaged where the separator may be a bag which is supported in a dirt collection chamber of the dirt separation device 15. The bag may collect dirt by filtering the dirt-laden air. In embodiments, the separator may be any other appropriate device to separate the dirt from the air, for example, an upstream filter that separates dirt from the dirt-laden air to cause it to collect in a dirt collection chamber of the dirt separation device 15. The dirt separation device 15 includes a pivotally moveable closing member 18*a* in the form of a cover or lid which enables a user to access the dirt collection chamber 18 to empty dirt collected therein, or for embodiments using a bag, to remove the bag therein.

The elongate member 14 includes a passage for carrying dirt-laden air from the surface cleaning tool 12 to the dirt separation device. In this example the surface cleaning tool 12 includes a motor for driving a rotatable floor agitating member or brush, so the elongate member 14 includes a further passage through which electrical cables may extend to provide an electric connection between the housing 16 and the motor in the surface cleaning tool 12.

The surface cleaning tool 12 is disconnectable from the elongate member 14, so that, for example, another tool can be connected to the free end of the elongate member 14. The elongate member 14 is also disconnectable from the housing 16, by way of a manually operated switch 17*a*. This enables the housing 16 to be used as a handheld surface cleaning apparatus, with the option of being able to connect another tool to the location from where the elongate member 14 is removed.

The housing 16 includes a handle for holding the apparatus 10, said handle including first 20 and second 21 user-graspable portions which are connected to each other substantially at right-angles. The dirt separation device 15 is positioned forwardly of the handle. A first end of the first user-graspable portion 20 is connected to the housing 16 and the portion 20 extends generally upwardly and away therefrom. The user-graspable portion 20 has an elongate axis C. A first end of the second user-graspable portion 21 is connected to the housing 16 and extends generally rearwardly away therefrom and from the elongate member 14. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22*a*, e.g. a switch, for turning the apparatus "on" is positioned at the connection of the second ends of the first 20 and second 21 user-graspable portions.

The suction source 13 is in the form of an electric motor 30*a* with an axle which is connected at one end to a fan. The motor 30*a* may be any appropriate motor, e.g. DC, AC, brushless.

The suction source 13 is positioned such that its axle extends transversely to the elongate axis H of the housing 16. The axes of the axle and axis A of the dirt separator device 15 extend perpendicularly to the elongate axis H of the housing 16. The axes of the axle and dirt collection chamber 18 are also parallel to one another in this embodiment but they may not be in other embodiments.

In embodiments, the dirt separation device 15 has an elongate axis A which is coaxial with an elongate axis A of the dirt collection chamber 18. In embodiments, the elongate axes of the dirt separation device and dirt collection chamber 18 may not be coaxial. In embodiments, the separator has an elongate axis which is coaxial with one or more or all of the elongate axes of the dirt separation device and the dirt collection chamber 18. In embodiments having a cyclonic separator, the elongate axis thereof corresponds to an axis about which dirt-laden air is caused to rotate by the cyclonic separator as it passes through the apparatus 10.

Figure 2:
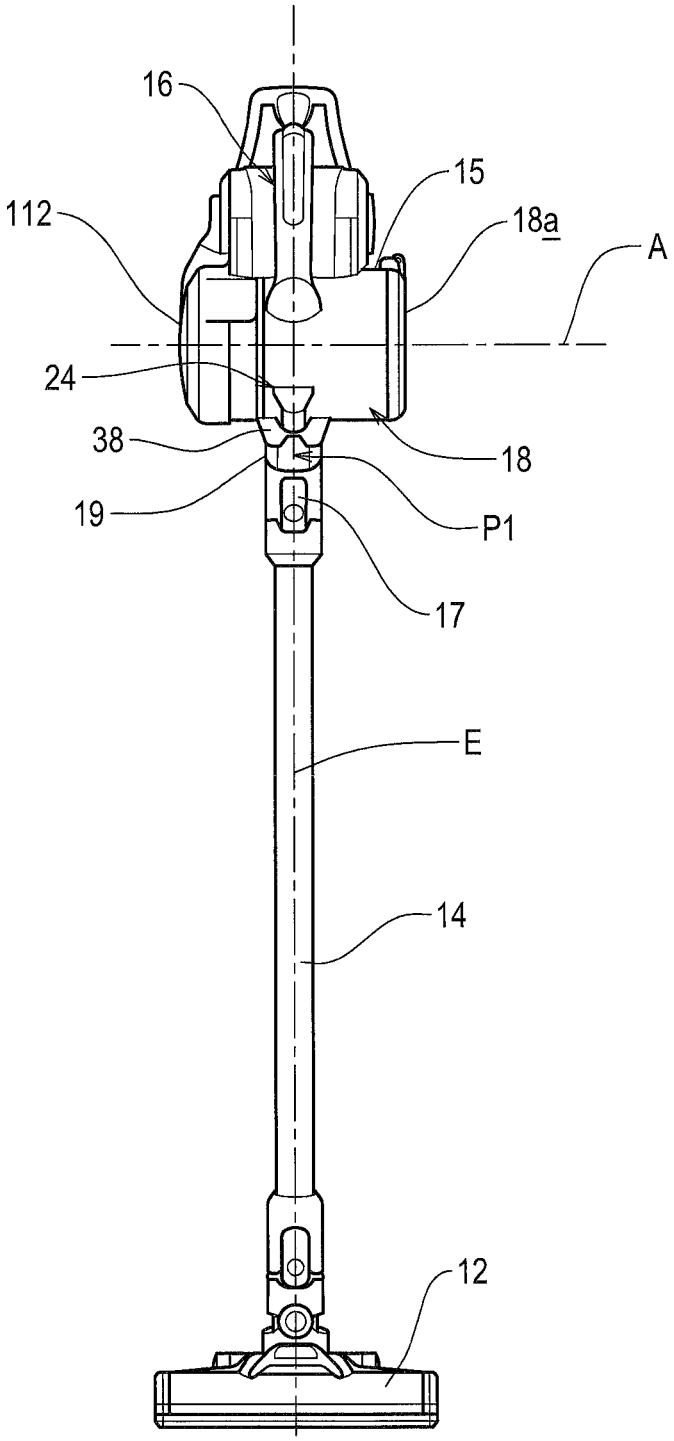
FIG. 2 is a front view of the apparatus of FIG. 1.
Figure 3:
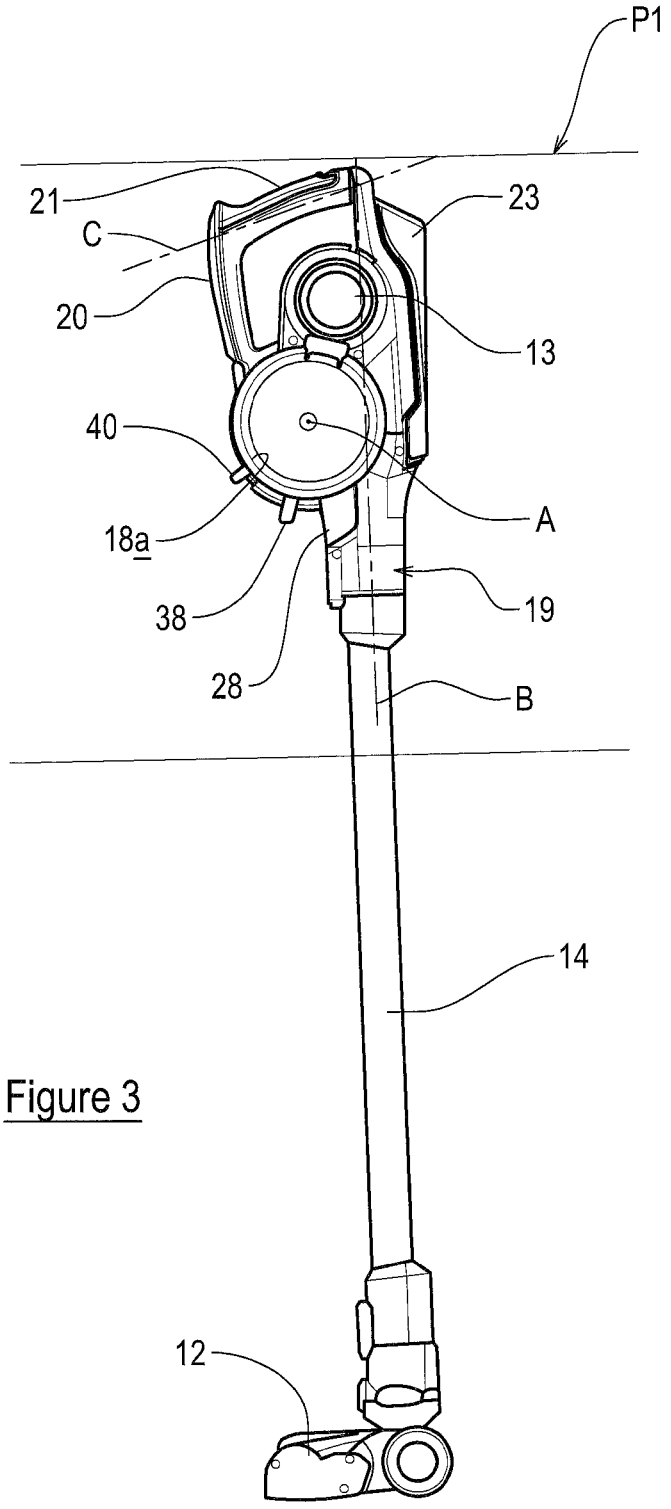
FIG. 3 is a side view of the apparatus of FIG. 1.

In embodiments, including those shown in the figures, the elongate axis B of the passage member 19 and the elongate axis C of the first user graspable portion 20 of the handle lie in a plane P1, and the elongate axis A of the dirt separation device 15 intersects the plane P1 (as shown in FIGS. 2 and 3). In embodiments, the elongate axis A is substantially horizontal in normal use.

Normal use of the surface cleaning apparatus 10 refers to use thereof when the elongate member 14 is inclined at an acute angle with respect to the surface being cleaned. In other embodiments for which the surface cleaning apparatus 10 is a cylinder cleaner, the housing supporting dirt separation device 15 may be generally upright with respect to the floor surface during normal use, and the elongate axis A may be parallel with or inclined with respect to the floor surface. For embodiments where the apparatus 10 is an upright cleaner, the housing may be inclined with respect to the floor surface and the elongate axis A may be parallel or inclined with the floor surface during normal use.

An upstream wall 112 of the housing 16 extends along the elongate axis H of the housing 16 and has an inner surface which partially defines an air flow passage from an outlet 104 of the dirt separation device to an inlet 103 of the suction source 13. In more detail, an inlet passage 37*a* to the suction source 13 has an end face which defines the inlet 103 and the upstream wall 112 has an end face which defines the outlet 104. The end face of the inlet passage 37*a* includes a seal extending around its perimeter which abuts in a sealing manner with an end face of the outlet 104 when the dirt separation device 15 is attached to the housing 16. When the dirt separation device 15 is pivoted, the respective seals slide past one another.

The dirt separation device 15 has a first end including the cover 18*a* and a second end including the upstream wall 112. A cylindrical wall 33 extends between the first and second ends. A portion of the surface of the wall 33 is received by a correspondingly shaped recessed surface of the housing 16. The remainder of the wall surface is accessible to the user when the dirt separation device 15 is attached to the housing 16. The dirt separation device 15 includes an engagement member 34 which extends outwardly and rearwardly away from the wall 33 along the elongate axis H of the housing 16. The engagement member 34 is generally in the form of a ledge. A free end of the engagement member 34 includes a part-circular portion.

The engagement member 34 is received in a formation 36 provided at the first end of the user-graspable portion 21 of the handle which is connected to the housing 16. The formation 36 provides a pivotal connection between the dirt separation device 15 and the housing 16. In embodiments, the pivotal connection is provided at a position generally centrally along the length of the dirt separation device 15. The pivotal connection is positioned centrally on the dirt separation device 15 with respect to the elongate axis of the dirt separation device 15. In other embodiments the pivotal connection may not be so positioned.

The formation 36 is a recess defined by the user-graspable portion 21. The formation 36 is part-circular in cross-section to fit around the free end of the engagement member 34 so as to prevent sideward movement thereof. The formation 36 has an open face such that the engagement member 34 can be moved into and out of the formation 36. The free end of the engagement member 34 is slightly larger than the formation 36. The relevant part of the user-graspable portion 21 which provides the formation 36 is made from a resilient material such that it deforms around the engagement member 34 to provide a positive engagement between the engagement member 34 and the user-graspable portion 21 to hold the dirt separation device 15 in place. However, the engagement still permits pivotal movement between the engagement member 34 and the user-graspable portion 21.

The wall 33 has an actuator member 24 and a user graspable member 38 positioned thereon. The actuator member 24 is positioned on the wall 33 generally centrally along the length of the dirt separation device 15. The actuator member 24 is positioned generally centrally with respect to the elongate axis of the dirt separation device 15. The actuator member 24 is positioned closer to the passage member 19 than the actuator member 24 is positioned relative to the user graspable handle.

The actuator member 24, as best seen in FIGS. 10*a* and 10*b*, has a first end including a user graspable portion 40 and a second end including a cam member 42. The first and second ends are connected by an arcuate portion which extends circumferentially around a portion of the wall 33.

The user graspable member 38 is a generally rectangular member which extends outwardly away from the wall 33.

The user graspable member 38 and user graspable portion 40 of the actuator member 24 are positioned to permit a user to handle the dirt separation device 15 by grasping both the user graspable member 38 and the user graspable portion 40 with one hand. In plan view, the user graspable member 38 and the user graspable portion 40 are spaced apart along a line which lies in plane P1. In plan view, the actuator member 24, user graspable portion 21 and the passage member 19 lie on a common axis.

The coupling device 22 is positioned above the inlet passage member 28 and forwardly of the dirt separation device 15. The coupling device 22 includes a coupling member 52 having a first end, a second end and a connecting part extending therebetween. The coupling member 52 is generally wedge-shaped in cross-section. The coupling member 52 tapers to an edge as the coupling member 52 extends about its elongate axis from the second end to the first end. The coupling member 52 includes a cam surface 54 near its second end. The cam surface 54 extends upwardly and rearwardly away from the second end.

The coupling device 22 is moveable between an extended state corresponding to the first position of the coupling device 22 (see FIG. 10*a*) and a retracted state corresponding to the second position of the coupling device 22 (see FIG. 10*b*).

A biasing member 56 biases the coupling device 22 to its extended state. In this embodiment, the biasing member 56 is a spring having a first end connected to the second end of the coupling member 52, and a second end connected to the wall 33.

In more detail, a housing 44 is positioned above the inlet passage member 28 and forwardly of the wall 33, i.e. at a portion of the wall which is near the passage member 19/includes the inlet passage member 28. The housing 44 surrounds respective portions of the inlet passage member 28 and the wall 33. The housing 44 includes the actuator member 24 and coupling device 22 therein. The housing 44 defines a space which extends between the interior surface of the housing 44 and the exterior surfaces of the inlet passage member 28 and the wall 33. The housing 44 has a first part 45 which is generally C-shaped in front view and which extends in a lengthwise direction over an upper surface of the inlet passage member 28 to define a channel 46 therebetween. The coupling member 52 is supported for movement within the channel 46. The channel 46 is open at its free end. In the extended state, shown in FIG. 10*a*, the free end of the coupling member 52 protrudes outside of the free end of the channel 46. The housing 44 has a second part 48 connected to the first part 45 which extends circumferentially around a portion of the wall 33 to define a channel 50. The actuator member 24 is supported for sliding movement inside the channel 50. The channel 50 is open at its free end. The user graspable portion 40 is positioned outside and near the free end of the channel 50. The cam member 42 is positioned near a lower end of the channel 50. The user graspable member 38 is fixed to the exterior surface of the second part 48 at a generally central position thereof.

A user operates the surface cleaning apparatus 10 in a known manner to clean a surface. The user may empty the dirt collection chamber 18 in different ways. The user may take the surface cleaning apparatus 10 to a waste container and place the end of the dirt separation device 15 including the closing member 18*a* over the waste container. The user may then open the cover 18*a* and tip the dirt separation device 15 towards the container to cause the dirt contained in the dirt collection chamber to fall into the waste container.

Alternatively, the user may release the dirt separation device 15 from the housing 16 and only take the dirt separation device 15 to empty the dirt collection chamber 18.

The dirt separation device 15 may be released by the user grasping the user graspable portion 40 and the user graspable member 38 in the same hand before pressing on the user graspable portion 40 to move the user graspable portion 40 towards the user graspable member 38.

FIG. 10*a* shows the dirt separation device 15 in its attached state and the coupling device in its first position before the user graspable portion 40 has been moved. In this position, it can be seen that the actuator member 24 rests on the coupling member 52. More particularly, the cam member 42 is supported on the cam surface 54 due to the biasing member 56 applying a force on the coupling member to hold the cam surface 54 against the cam member 24. In this position, a flange 58 of the cam member 24 abuts a corresponding flange 60 on the interior surface of the housing 44 such that the actuator member 24 cannot be moved there past.

When the user operates the actuator member 24, the actuator member 24 slides along the channel 50, i.e. it rotates relative to the elongate axis A, and the cam member 24 applies a downward force on the cam surface 54. As the cam surface 54 is inclined, a component of the applied force is translated into a linear movement of the cam surface towards the wall 33. The coupling member 52 thus moves towards its retracted state against the force of the biasing member 56. This will continue until the coupling member 52 is fully retracted as shown in FIG. 10*b*.

In the second position, the free end of the coupling member 52 is no longer coupled to the passage member 19. At this point, the user must lift the dirt separation device 15 in a direction towards the handle. In doing so, the dirt separation device 15 will pivot about the pivotal connection between the engagement member 34 and the formation 36. The engagement member 34 will become detached from the formation 36 on sufficient rotation of the dirt separation device 15 due to the formation 36 flexing around the engagement member 34. Movement of the dirt separation device 15 at different stages before the dirt separation device 15 is wholly detached is shown in FIGS. 13, 14 and 15 respectively. The user may carry/handle the dirt separation device 15 by retaining his or her grip on the actuator member 24 and the user graspable member 38 to perform the emptying operation whilst using his or her other hand to open the closing member 18*a*. It will be appreciated that in other embodiments not including the user graspable member 38, the user may handle the dirt separation device by retaining his or her grip on the actuator member 24.

In order to attach the dirt separation device 15 to the housing 16, the user handles the dirt separation device 15 using the actuator member 24 and the user graspable member 38 to push the engagement member 34 into formation 36. The formation 36 will flex around the engagement member 34 to hold it relative thereto. The user will then pivot the dirt separation device 15 downwardly towards the passage member 19 whilst operating the actuator member 24 so that the coupling device 22 is in its retracted condition. The inlet passage member 28 and passage member 19 will become aligned when the wall 33 abuts the housing 16. The user then releases the actuator member 24 and the biasing member 56 pushes against the actuator member 24 to lift the actuator member 24 back to its non-operative state. In doing so, the coupling device 22 moves into its extended condition and is received in formation 27.

It will be appreciated that the provision of the actuator member 24 and coupling device 22 as described provides a convenient way of detaching the dirt separation device 15 from the housing 16. It is ergonomically advantageous and intuitive for the user.

An advantage of having a pivotal connection between the dirt separation device 15 and the housing 16 is that the user can utilise a mechanical advantage to detach the dirt separation device 15.

Providing a coupling device which couples the inlet passage member to the passage member of the housing provides an advantageous locating mechanism for attaching the dirt separation device 15 to the housing 16. The user can readily align the inlet passage member to the passage member to ensure the dirt separation device 15 has been correctly attached to the housing 16.

The present invention may be employed as part of a cylinder cleaner. For such a cleaner, its housing may support the suction source, the dirt separation device and, in normal use, the housing is supported on a floor surface and the elongate axis of the dirt separation device is parallel with the floor surface.

Figure 8:
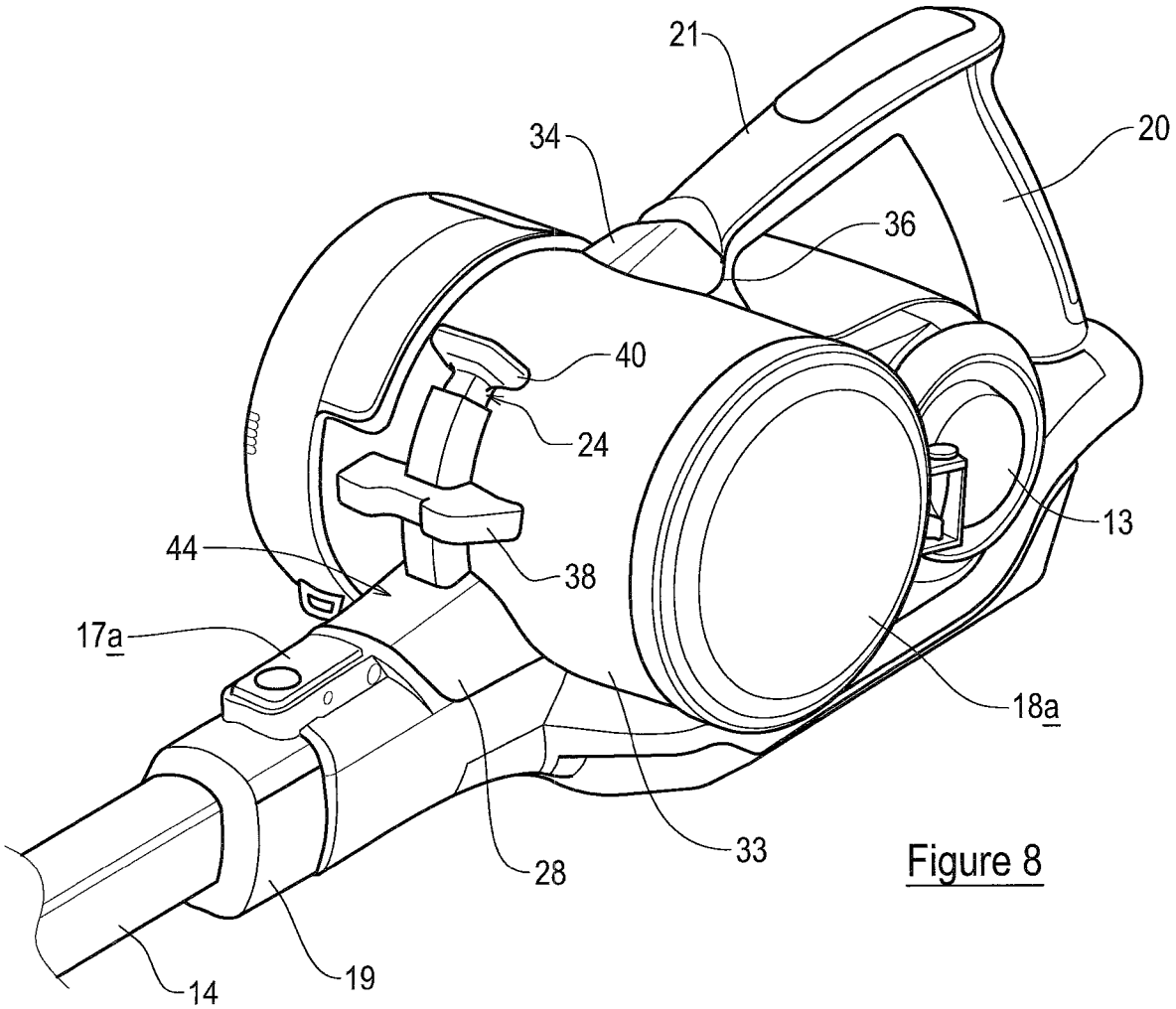
FIG. 8 is a further partial perspective view of the apparatus of FIG. 1.

FIG. 7 shows the elongate axis H at a particular height but it will be appreciated that the axis H could be a different height and that axis H should be understood to denote an axis which is parallel to the horizontal or lengthwise direction in which the housing 16 extends between its distal ends, as viewed in side cross-section (such as that shown in FIG. 8). In other words, parallel to the generally elongate dimension of the housing 16.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning apparatus including:

a housing having an elongate axis (H), the housing supporting:

a suction source;

a dirt separation device having an elongate axis (A) including:

a separator for separating dirt from dirt-laden air;

a dirt collection chamber for receiving separated dirt;

a coupling device moveable between a first position in which the coupling device inhibits release of the dirt separation device from the housing and a second position in which the coupling device permits release of the dirt separation device from the housing;

a user graspable member positioned on the dirt separation device; and an actuator member for effecting movement of the coupling device between its first and second positions, wherein the actuator member includes a user graspable portion positioned on the dirt separation device; and a passage member for transporting dirt-laden air to the dirt separation device, the passage member having an elongate axis (B), wherein the dirt separation device is pivotally moveable relative to the housing about an axis generally parallel to the elongate axis (A) of the dirt separation device to effect release of the dirt separation device from the housing, and wherein the user graspable member and the user graspable portion of the actuator member are positioned to permit a user to handle the dirt separation device by grasping both the user graspable member and the actuator member with one hand.

2. A surface cleaning apparatus according to claim 1, wherein, in plan view, the user graspable member and the user graspable portion of the actuator member are spaced apart along a line which lies in plane (P1).

3. A surface cleaning apparatus including:

a housing having an elongate axis (H), the housing supporting:

a suction source;

a dirt separation device having an elongate axis (A) and including first and second ends connected by a wall, a portion of the wall is accessible to a user when the dirt separation device is supported by the housing, the dirt separation device including:

a separator for separating dirt from dirt-laden air;

a dirt collection chamber for receiving separated dirt;

a coupling device moveable between a first position in which the coupling device inhibits release of the dirt separation device from the housing and a second position in which the coupling device permits release of the dirt separation device from the housing;

an actuator member for effecting movement of the coupling device between its first and second positions, wherein the actuator member is provided on the portion of the wall between the first end and the second end which is accessible to a user; and a passage member for transporting dirt-laden air to the dirt separation device, the passage member having an elongate axis (B), wherein the dirt separation device is pivotally moveable relative to the housing to effect release of the dirt separation device from the housing.

4. A surface cleaning apparatus including:

a housing having an elongate axis (H), the housing supporting:

a suction source;

a dirt separation device having an elongate axis (A) including:

a separator for separating dirt from dirt-laden air; and a dirt collection chamber for receiving separated dirt, wherein the dirt separation device is releasably connected to the housing;

a passage member for transporting dirt-laden air to the dirt separation device, the passage member having an elongate axis (B), wherein the dirt separation device is pivotally moveable relative to the housing to effect release of the dirt separation device, wherein the dirt separation device is a horizontal dirt separation device, and wherein the dirt separation device remains horizontal while it is released from the housing.

5. A surface cleaning apparatus according to claim 4, wherein a filter for filtering relatively clean air outputted from the dirt collection chamber is supported in the dirt separation device.

6. A surface cleaning apparatus according to claim 4 wherein, in normal use, the housing is supported for movement along a floor surface and the elongate axis (A) of the dirt separation device is parallel with the floor surface.

7. A surface cleaning apparatus according to claim 4 including a pivotal connection between the dirt separation device and the housing, such that the dirt separation device pivots about an axis generally parallel to the elongate axis (A) of the dirt separation device while the dirt separation device is released from the housing.

8. A surface cleaning apparatus according to claim 7 wherein the pivotal connection includes a recess to permit the detachment of the dirt separation device therefrom.

9. A surface cleaning apparatus according to claim 4 including a coupling device moveable between a first position in which the coupling device inhibits release of the dirt separation device from the housing and a second position in which the coupling device permits release of the dirt separation device from the housing.

10. A surface cleaning apparatus according to claim 9 wherein the dirt separation device includes first and second ends connected by a wall and a portion of the wall is accessible to a user when the dirt separation device is supported by the housing.

11. A surface cleaning apparatus according to claim 9, wherein the coupling device is in an extended condition when the coupling device is in its first position and the coupling device is in a retracted condition when the coupling device is in its second position.

12. A surface cleaning apparatus according to claim 9 including an actuator member for effecting movement of the coupling device between its first and second positions, and including a user graspable handle having an elongate axis (C).

13. A surface cleaning apparatus according to claim 12 wherein, in plan view, the actuator member, user graspable handle and the passage member lie on a common axis.

14. A surface cleaning apparatus according to claim 12, wherein the actuator member is positioned closer to the passage member than the actuator member is positioned relative to the user graspable handle.

15. A surface cleaning apparatus according to claim 12 wherein the actuator member includes a cam member and the coupling device includes a cam follower surface for engaging with the cam member when the actuator member is operated such that movement of the actuator member effects movement of the coupling device.

16. A surface cleaning apparatus according to claim 15, wherein the cam member and cam follower surface co-operate so as to translate a rotational movement of the cam member into a linear movement of the coupling device.

17. A surface cleaning apparatus according to claim 12 wherein the actuator member is positioned generally centrally on the dirt separation device with respect to an elongate axis (A) of the dirt separation device.

18. A surface cleaning apparatus according to claim 4 including a user graspable handle having an elongate axis (C).

19. A surface cleaning apparatus according to claim 18 wherein the dirt separation device is pivotally connected to a portion of the user graspable handle.

20. A surface cleaning apparatus according to claim 18 wherein the dirt separation device is positioned forwardly of the user graspable handle, and forwardly of the suction source.

21. A surface cleaning apparatus according to claim 18 wherein the elongate axis (B) of the passage member and the elongate axis (C) of the user graspable handle lie in a plane (P1), and the elongate axis (A) of the dirt separation device intersects the plane (P1).

22. A surface cleaning apparatus according to claim 21 wherein the passage member is provided by at least one of the housing or the dirt separation device.

23. A surface cleaning apparatus according to claim 4 wherein the separator is a cyclonic separator.

24. A surface cleaning apparatus including:

a housing having an elongate axis (H), the housing supporting:

a suction source;

a horizontal dirt separation device having an elongate axis (A) including:

a separator for separating dirt from dirt-laden air;

a dirt collection chamber for receiving separated dirt; and a coupling device moveable between a first position in which the coupling device inhibits release of the horizontal dirt separation device from the housing and a second position in which the coupling device permits release of the horizontal dirt separation device from the housing; and a passage member for transporting dirt-laden air to the horizontal dirt separation device, the passage member having an elongate axis (B), wherein the horizontal dirt separation device is pivotally moveable relative to the housing to effect release of the horizontal dirt separation device from the housing, wherein the coupling device is provided on the horizontal dirt separation device, wherein the horizontal dirt separation device includes an inlet passage member for fluid communication with the passage member, and wherein the coupling device couples the inlet passage member to the passage member.

25. A surface cleaning apparatus according to claim 24 wherein the coupling device is provided on the inlet passage member.

* * * * *